US005268726A

United States Patent [19]

Oleksa et al.

[11] Patent Number: 5,268,726

[45] Date of Patent: Dec. 7, 1993

[54] ELECTROPHOTOGRAPHIC REPRODUCTION APPARATUS HAVING IMPROVED FUSER TO PREVENT WRINKLING OF ENVELOPES USING INTERMITTENT PRESSURE

[75] Inventors: Stephen A. Oleksa, Lexington; Larry J. Rice, Nicholasville; John O. Schaefer, Lexington, all of Ky.

[73] Assignee: Lexmark International, Inc., Greenwich, Conn.

[21] Appl. No.: 969,538

[22] Filed: Oct. 30, 1992

Related U.S. Application Data

[63] Continuation of Ser. No. 565,583, Aug. 10, 1990.

[51] Int. Cl.[5] ..... G03G 15/20

[52] U.S. Cl. ..... 355/290; 219/216; 355/295; 430/124

[58] Field of Search ..... 355/285, 290, 295; 430/33, 98, 99, 124; 219/216, 469

[56] References Cited

U.S. PATENT DOCUMENTS

| | | | |
|---|---|---|---|
| 4,119,831 | 10/1978 | Sato | 219/216 |
| 4,232,959 | 11/1980 | Ateya et al. | 219/216 X |
| 4,753,543 | 6/1988 | Mochimaru et al. | 400/119 |
| 4,873,553 | 10/1989 | Inaba | 355/295 |
| 4,958,195 | 9/1990 | Firth, III et al. | 355/290 |

*Primary Examiner*—Leo P. Picard
*Assistant Examiner*—Christopher Horgan
*Attorney, Agent, or Firm*—John J. McArdle, Jr.

[57] ABSTRACT

An electrophotographic printer (11) including a fuser (16, 17) for fusing a toned image onto an envelope (13) passing through a fuser nip (14). Wrinkling and treeing of the envelope (13) is substantially eliminated by removing the pressure on the envelope (13) in the fuser nip (14) for one or more brief intervals during the fusing process. To do this, a solenoid (21) is intermittently driven to remove the force of a spring (18) urging the fuser rolls (16, 17) together.

15 Claims, 4 Drawing Sheets

$X_0$ = DISTANCE FROM LEADING EDGE OF ENVELOPE TO FUSER ROLLS PLUS ANY BUILT IN DELAYS (TYPICAL VALUES FROM 1.3" TO 1.7")

$\Delta X$ = DISTANCE BETWEEN PULSES (2.0" APPROX. 1.0 SEC)

REF. VOLTAGE/SOLENOID CURRENT WAVEFORM TO CONTROL DYNAMICS OF BACKUP ROLL

| | |
|---|---|
| $0 — t_1$ =8mSEC | $I_1$ =0.5 AMPS |
| $t_1 — t_2$ =3mSEC | $I_2$ =2.0 TO 3.0 AMPS |
| $t_2 — t_3$ =26mSEC | $I_3$ =1.0 TO 1.5 AMPS |

ELECTROPHOTOGRAPHIC REPRODUCTION APPARATUS HAVING IMPROVED FUSER TO PREVENT WRINKLING OF ENVELOPES USING INTERMITTENT PRESSURE

This is a continuation of application Ser. No. 07/565,583 filed on Aug. 10, 1990.

BACKGROUND OF THE INVENTION

This invention relates generally to electrophotographic reproduction apparatus, such as printers and copiers, which employ pressure for fusing a toned image onto a transfer medium. The invention more particularly concerns such apparatus in which, at least some of the time, images are fused to multiple ply transfer media such as envelopes.

In the case of electrophotographic printers, for example, envelopes as well as cut sheets of paper can serve as the transfer media upon which information is printed. Such a printer typically employs a fuser which fuses a toner image of the information to be printed onto the paper or envelope. This fuser is usually made up of a fuser roller urged against a backup roller to form a pressure nip through which the transfer medium passes. In one form of fuser, the fuser roll is heated and has a relatively rigid outer surface, while the backup roll is softer and can be deformed somewhat to form the pressure nip.

Normally, paper can be fed through this type of fuser without difficulty but envelopes tend to crease, fold, or form wrinkles (known as "treeing").

The cause for these problems seems to be non-uniform feeding across the envelope surface due to the multiple ply nature of the envelope. Efforts to correct this problem have included the use of a segmented pressure roller and the employment of roller designs of different shapes. Another approach to solving the problem is to take advantage of the fact that there typically are non-printing zones at the leading and trailing edges of an envelope. In this approach, a reduced amount of pressure at the fuser nip is applied to the leading and trailing edges of the envelope so that the large force at the nip required for fusing is only applied where toner images will be placed on the envelope. This improves the situation somewhat, but creasing and treeing can still occur along the printable zone of an envelope.

It is the general aim of the invention to provide an electrophotographic reproduction apparatus of the foregoing type in which creasing, folding, and treeing of envelopes is substantially eliminated.

SUMMARY OF THE INVENTION

In carrying out the invention, an electrophotographic reproduction apparatus is provided which includes a fuser for fusing a toned image to a transfer medium by advancing the transfer medium through a pressure zone and in which the pressure on the transfer medium in the pressure zone is reduced substantially for one or more brief intervals during the fusing process.

An advantage of the invention is that virtually all wrinkling and treeing of an envelope fused in the apparatus is eliminated, while acceptable fusing of the image is obtained.

In one embodiment of the invention, the fuser takes the form of a heated fuser roll and a backup roll biased together by a spring force to form a pressure nip, wherein the spring force is substantially reduced for one or more brief intervals during fusing.

Further objects and advantages of the invention, and the manner of their implementation, will become apparent upon reading the following detailed description and upon reference to the drawings in which:

DETAILED DESCRIPTION

Figure 1:
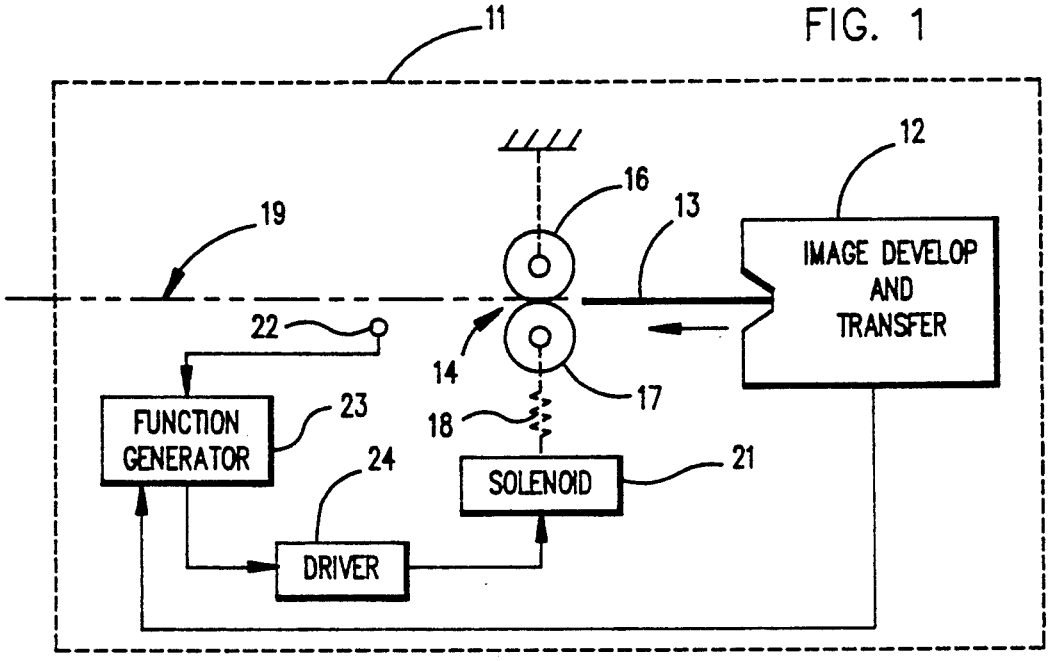
FIG. 1 is a diagrammatic illustration of an electrophotographic reproduction apparatus in accordance with the present invention.

While the invention is susceptible to various modifications and alternative forms, a specific embodiment thereof has been shown by way of example in the drawings and will herein be described in detail.

It should be understood that it is not intended to limit the invention to the particular form disclosed, but, on the contrary, the intention is to cover all modifications and alternatives falling within the spirit and scope of the invention.

Turning first to FIG. 1, an electrophotographic printer 11 includes conventional imaging, development and transfer stations, designated collectively as 12, for placing a toner image on a transfer medium, such as an envelope 13. The toner image on the envelope 13 is fused to the envelope by heat and pressure as it passes through a nip 14 between a fuser roll 16 and a backup roll 17, which are biased together by a spring 18.

In the illustrated printer, the fuser roll 16 is heated, such as by an internal heating lamp (not shown), and the fusing of the toner image on the envelope 13 as it passes through the nip 14 is a combination of heat and pressure fusing. The envelope 13 passes through the nip 14 and exits the printer 11 along the path designated 19. In accordance with the invention, as the envelope 13 moves through the nip 14, the force of the spring 18 urging the rolls 16 and 17 together is briefly removed several times during the fusing process. This permits the layers of the envelope to move relative to one another, substantially eliminating wrinkling and creasing of the envelope during fusing.

In order to relieve the spring force, a solenoid 21, operable to reduce the force of the spring 18, is momentarily activated several times as the envelope 13 passes through the nip 14. To do this, a sensor 22 senses the leading edge of the envelope 13 as the envelope has begun to pass through the nip 14. In response to the sensing of the leading edge of the envelope 13, a function generator 23 briefly supplies a drive signal to a solenoid driver 24 to drive the solenoid 21. The drive signal is repeated several times as the envelope 13 passes through the fuser nip 14.

Figure 2:
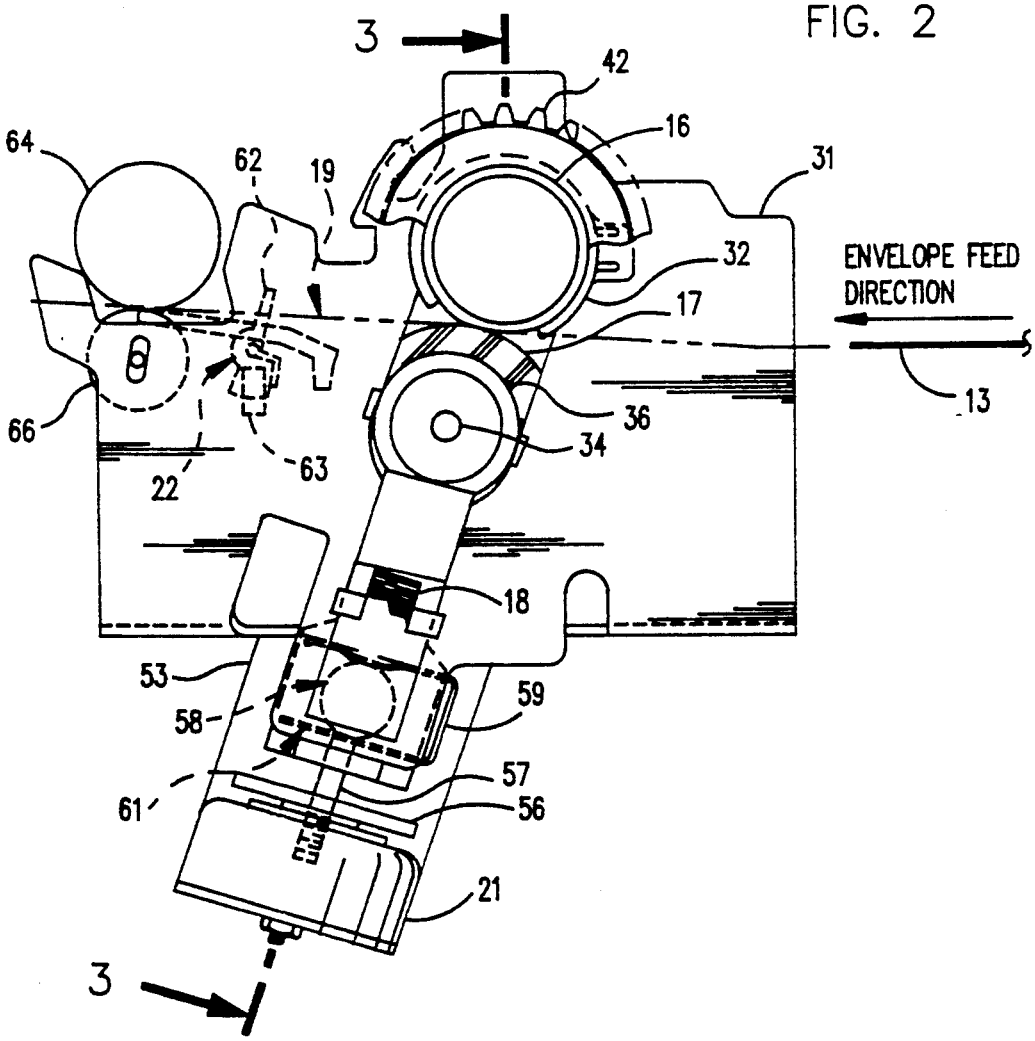
FIG. 2 is an end view of a fuser mechanism, with portions removed, in accordance with the present invention.
Figure 3:
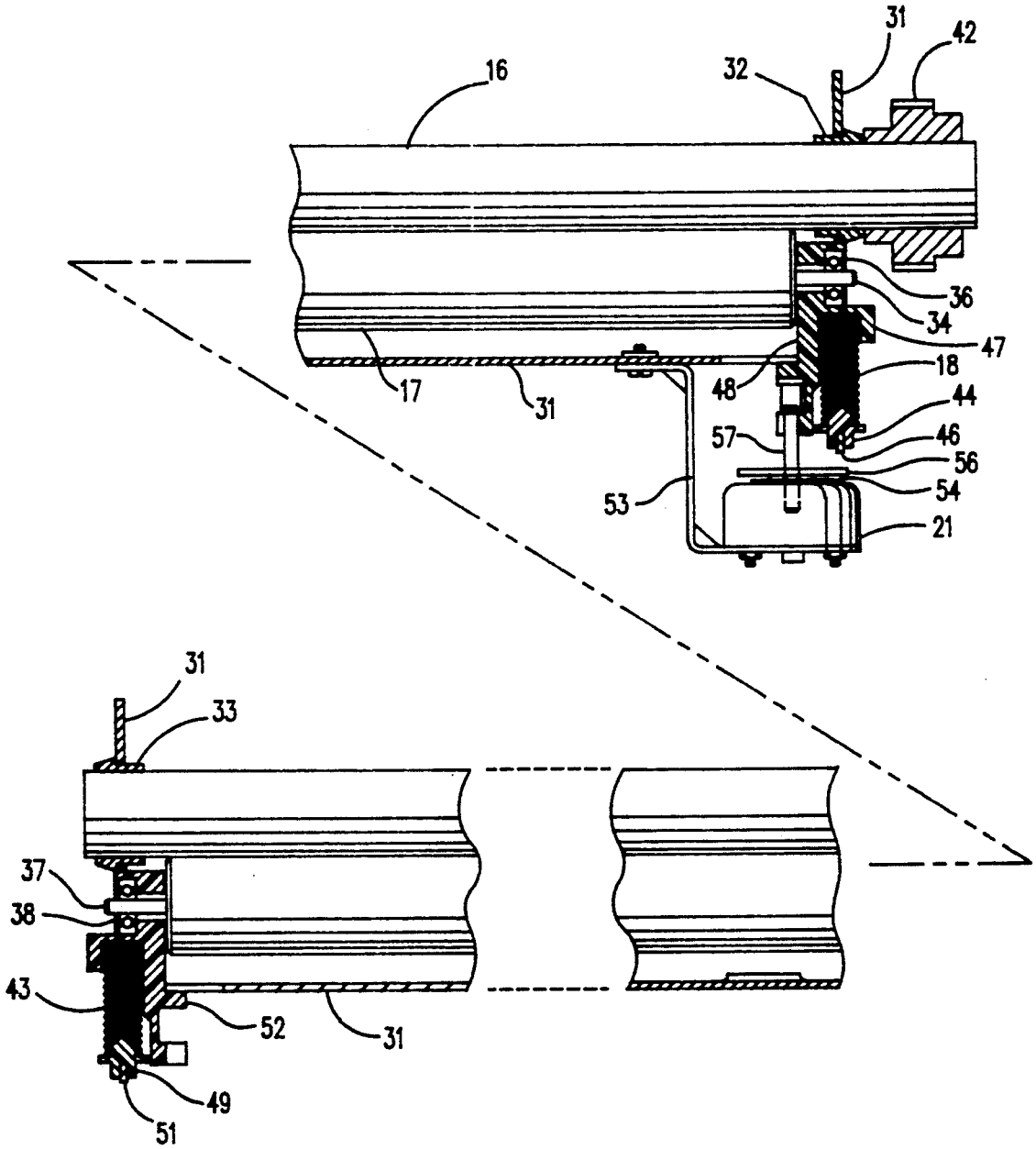
FIG. 3 is a view, partially in section, of the fuser apparatus of FIG. 2.

With reference now to FIGS. 2 and 3, and considering the fuser rolls 16 and 17, spring 18, and solenoid 21 in more detail, the fuser rolls 16 and 17 are mounted at each end in a frame 31. The fuser roll 16 is a heated roll (heated by an interior bulb, not shown) having a hard exterior surface coated with Teflon or a similar material. The backup roll 17 has a yieldable surface, formed by a layer of material such as silicon rubber. The fuser roll 16 rotates within bearings 32 (shown partially broken away in FIG. 2), 33 at each end of the fuser roll. The backup roll 17 has a metal spindle 34 rotatably supported in a ball bearing 36 at one end of the backup roll and a corresponding spindle 37 and ball bearing 38 at its other end. The spindles 34, 37 extend from a metal core (not shown) of the backup roll 17 which is surrounded by a silicon rubber layer, which contacts the fuser roll at the fuser nip.

The fuser roll 16 is driven through a gear 42 secured to an end of the roll 16, by the printer drive (not shown). The backup roll 17 is loaded against the hot roll 16 by the spring 18, and a spring 43 at the other end of the roll, and is driven by the hot roll 16 through friction. The loading of the soft backup roll 17 against the hot roll 16 causes a slight flattening of the backup roll 17 along its length, this deformation defining the fuser roll nip.

The spring 18 is supported at its lower end by a plastic spring holder 44 (not shown in FIG. 2) mounted on a portion 46 of the frame 31. The top of the spring 18 is received within a portion 47 of a plastic backup roll bearing housing 48, which carries the bearing 36 for the backup roll.

At the other end of the rolls 16, 17, the spring 43 is supported at its lower end on a spring holder 49 which is in turn supported on a portion 51 of the frame 31. A bearing housing 52, corresponding to the bearing housing 48, receives the upper end of the spring 43 and holds the backup roll bearing 38. The spring 43 urges the bearing housing 52 and bearing 38 upwardly, and the spring 18 urges the bearing housing 48 and the bearing 36 upwardly, thereby maintaining the pressure between the fuser roll 16 and the backup roll 17 at the fuser nip.

In the illustrated printer, envelopes are fed near the end of the fuser roll nip adjacent the spring 18 and the bearing 36. The pressure at the fuser roll nip at this end of the roll is momentarily relieved a number of times during the fusing of an envelope by exerting a force to overcome the force of the spring 18.

The force to overcome the load of the spring 18 is supplied by the solenoid 21. The solenoid 21 is mounted on a bracket 53 which is attached to the frame 31. A pin 57 is attached to the core 54 of the solenoid 21. The pin 57 has an enlarged cylindrical head 58 received within a spring clip 59 mounted in the bearing housing 48. The pin 57 extends through an opening in the bottom portion 61 of the spring clip 59 and is free to tilt and translate slightly in any direction to accommodate misalignments of the solenoid 21 and the bearing housing 48.

When the solenoid 21 receives drive current, the pin 57 and bearing housing 48 are pulled downwardly in opposition to the force of the spring 18, releasing the pressure to the fuser nip at the end of the fuser rolls where envelopes pass and the solenoid 21 is located.

An envelope 13 is driven into the fuser nip by the printer paper feed system (not shown). As the envelope 13 passes through the nip, stresses are generated on the surface of the plys of paper of the envelope. These stresses typically cause a wave or bubble to be formed between the two layers of the envelope 13.

In the present printer, as the leading edge of the envelope 13 exits the nip and continues down the paper path 19, the envelope engages an exit flag 62, activating a photosensor 63. The exit flag 62 and the photosensor 63 comprise the sensor 22 of FIG. 1. A pulse from the activation of the photosensor 63 initiates the operation of the electrical driver circuit 24 and the function generator 23, which drive the solenoid 21.

The activation of the solenoid allows the stresses on the envelope 13 to relax and permits bubbles to disappear. As the envelope 13 continues to move through the nip, more stresses are generated, and additional bubbles form. Therefore, after a selected time interval from the first actuation of the solenoid 21, the solenoid is again actuated to release the pressure between the fuser and backup rolls at the solenoid end of the rolls.

In the present instance, the spacing between pulses of the solenoid are chosen in dependence upon various parameters. Stresses build up in envelopes at rates which depend upon the weight of the paper used to form the envelope (for example, 16 pounds to 24 pounds), and upon humidity conditions. In the illustrated fuser system, a spacing of approximately 1.5 to 2 inches between activations of the solenoid has been found to operate satisfactorily over a range of papers and for humidities normally encountered.

After fusing, upper and lower redrive rollers 64, 66 in the printer pull the envelope 13 along the path 19 as the envelope moves through and out of the fuser roll nip. The function generator 23 and driver 24 continue pulsing the solenoid as the envelope 13 is pulled along the paper path 19 until the trailing end of the envelope 13 exits the fuser nip.

When the solenoid 21 is pulsed, the current to the solenoid from the solenoid driver is controlled to rise and fall in a profile to be described subsequently. The current profile minimizes the dynamics of the backup roll/solenoid system, to provide quiet operation of the system. The duration of the solenoid pulse is such that separation between the fuser roll 16 and the backup roll 17 occurs for about 20 milliseconds. This provides time for the removal of the built-up stresses on the envelope 13 and yet maintains all portions of the envelope in the fuser nip under pressure for a sufficient time to provide adequate fuse quality of the toner image on the envelope.

In one form of fuser, the envelope 13 enters the fuser nip at a velocity of two inches per second. A pressure load of approximately 15 pounds between the silicon rubber backup roll and the rigid hot roll creates a deformation in the backup roll of approximately 0.100 inches. Therefore, a given section of the envelope is in the fuser nip for about 50 milliseconds. The set-point temperature for the fuser roll nip is about 180° C. This pressure, heat and time is sufficient to attain good fuse quality over a wide range of operating conditions.

As described earlier with regard to FIG. 1, once the leading edge of the envelope 13 reaches the paper exit sensor 22, a signal is sent to a function generator 23 which triggers a voltage pulse. This voltage pulse is used as a reference for a current driver 24 which converts it to a current used to drive the linear push/pull solenoid 21.

Figure 4:
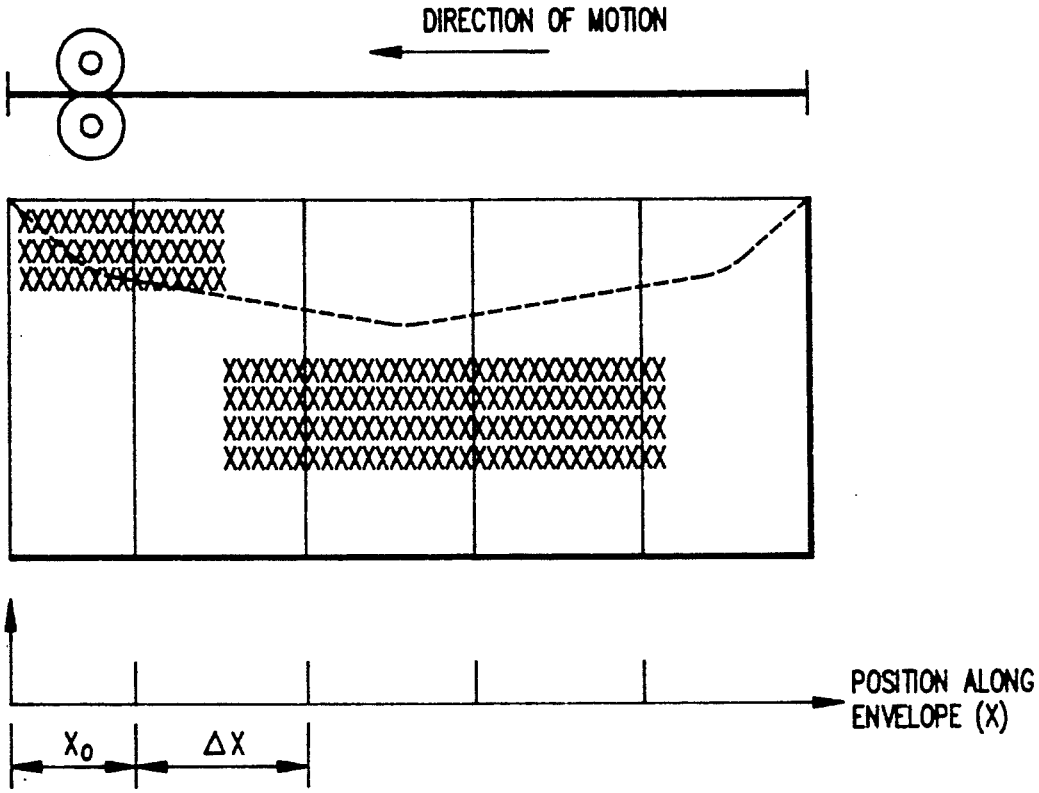
FIG. 4 is an illustration of the locations of reduced nip pressure in the fusing of an envelope in accordance with an embodiment of the present invention.

With reference now to FIG. 4, after the trigger signal is received, a time interval sufficient to allow the leading edge of the envelope to reach the redrive rollers (41,42 in FIG. 2) is allowed to pass before the first solenoid pulse is initiated. This delay interval causes the first pulse to occur approximately 1.5 inches from the leading edge of the envelope. This distance is designated $X_0$ in FIG. 4. The number of pulses and spacing therebetween are controlled by the function generator 23 in the illustrated form of the invention. A Wavetek 175 arbitrary waveform generator has been used for this purpose in one form of the invention. Advantageously, the function generator signals could be produced by the control software for the printer as part of the general printer control function.

In the present implementation, the pulses occur about one second apart, or each two inches along the envelope. This results in four pulses (as shown in FIG. 4) for a number 10 (9½ inch) envelope, or three pulses for a number 7¾ (7½ inch) envelope. The length of the envelope can be automatically determined in the pre-fuser portion 12 of the printer 11 such as by measuring the time differential between making and breaking a paper sensor switch. This information can be used by the function generator 23 to determine the number of solenoid pulses required.

Figure 5:
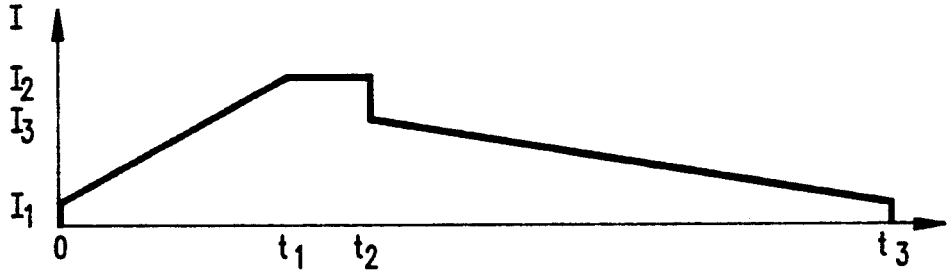
FIG. 5 is an illustration of a solenoid current waveform for each nip pressure reduction location.
Figure 6A:
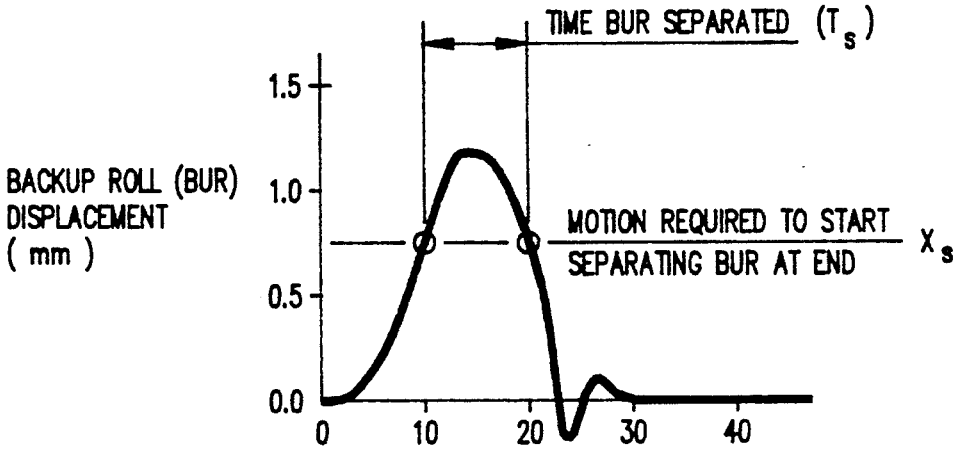
FIG. 6 is an illustration of fuser backup roll displacement relative to the solenoid current for each nip pressure reduction location.
Figure 6B:
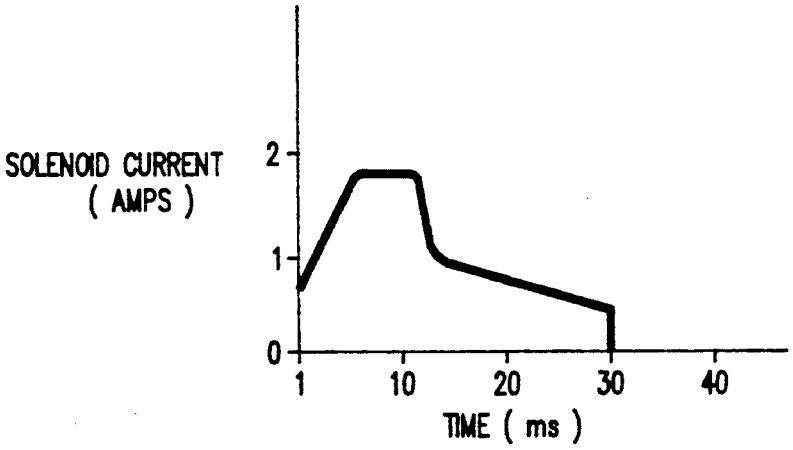

The current pulse produced by the driver 24 tracks the voltage produced by the function generator 23, and takes the form shown in FIGS. 5 and 6. The current pulse to the solenoid 21 results in a displacement of the backup roll as shown in FIG. 6. The motion required to separate the rolls in the illustrated form of the invention is approximately 0.030 inches. The time of separation for proper function can be as short as 5 milliseconds and as long as 20 milliseconds. Between these limits, the envelope has sufficient time to "relax" and the fuse grade is not significantly affected. In the present fuser arrangement, the heated roll is a one millimeter thick aluminum tube having a 0.001 inch thick coating of Teflon or Silverstone or the like. The backup roll is made up of a 10 millimeter diameter steel rod inside a 6 millimeter thick 25 dur SHORE A silicon rubber roll.

We claim:

1. An electrophotographic reproduction apparatus comprising:
- means for developing toned images and transferring a toned image to each transfer medium in a series of transfer media;
- means for fusing a toned image to each transfer medium by advancing each transfer medium with a toned image thereon through a pressure nip; and
- means for substantially reducing the pressure at the pressure nip for one or more brief intervals as the toned image on each transfer medium in the series of transfer media advances through the pressure nip regardless of fuser conditions.

2. The apparatus of claim 1 in which the means for fusing includes a pair of fuser rolls biased together to form a pressure nip through which the transfer medium passes.

3. The apparatus of claim 2 in which at least one of the fuser rolls is heated.

4. The apparatus of claim 2 in which the fuser rolls are biased together by a spring coupled to one of the rolls.

5. The apparatus of claim 4 in which the spring is coupled at one end to one of the rolls ad at the other end to a solenoid which is mounted on the reproduction apparatus, and in which the means for substantially reducing the pressure at the pressure nip includes means for activating the solenoid to remove the spring force from said one of the rolls.

6. An electrophotographic reproduction apparatus comprising:
- means for developing a toned image and transferring that image to a transfer medium;
- means for fusing the toned image to the transfer medium by advancing the transfer medium with the toned image thereon through a pressure nip;
- means for substantially reducing the pressure at the pressure nip for one or more brief intervals as the toned image on the transfer medium advances through the pressure nip;
- means for detecting the position of the transfer medium as it begins to pass through the pressure nip and for producing a position signal in response to such detection of the transfer medium, in which the means for substantially reducing the pressure at the pressure nip is responsive to the position signal.

7. The apparatus of claim 6 in which the apparatus is a printer.

8. A printer comprising:
- means for developing a toned image and for transferring the toned image to a multiple ply transfer medium;
- means for fusing the toned image to the transfer medium by advancing the transfer medium carrying the toned image through a pressure nip; and
- means for substantially reducing pressure at the pressure nip by a sufficient amount to permit the plys of the transfer medium to move relative to one another for one or more brief intervals during fusing as the transfer medium and toned image advance through the pressure nip.

9. The printer of claim 8 in which the multiple ply transfer medium has two plys and in which the multiple ply transfer medium has at least one edge along which the two plys are connected.

10. The printer of claim 9 in which the transfer medium is an envelope.

11. An electrophotographic reproduction apparatus comprising:
- means for developing a toned image and transferring that image to a transfer medium;
- means for fusing the toned image to the transfer medium by advancing the transfer medium with the toned image thereon through a pressure nip defined by a pair of fuser rolls biased together; and
- means for reducing the pressure at the pressure nip for one or more brief intervals as the toned image on the transfer medium advances through the pressure nip by separating the fuser rolls for one or more brief intervals as the toned image on the transfer medium advances through the pressure nip.

12. An electrophotographic reproduction apparatus comprising:
- means for developing a toned image and transferring that image to a transfer medium;
- a pair of fuser rolls biased together to form a pressure nip wider than the transfer medium wherein the transfer medium is advanced with the toned image thereon through an end of the pressure nip; and
- means for substantially reducing the pressure at said end of the pressure nip for one or more brief intervals as the toned image on the transfer medium advances through the pressure nip.

13. An electrophotographic reproduction apparatus comprising:

means for developing a toned image and transferring that image to a transfer medium;

means for fusing the toned image to the transfer medium by advancing the transfer medium with the toned image thereon through a pressure nip; and means for substantially reducing the pressure at the pressure nip at timed intervals as the toned image on the transfer medium advances through the pressure nip.

14. An electrophotographic reproduction apparatus comprising:

means for developing a toned image and transferring that image to a transfer medium;

means for fusing the toned image to the transfer medium by advancing the transfer medium with the toned image thereon through a pressure nip; and means for substantially reducing the pressure at fixed intervals of distance of travel of the transfer medium as the toned image on the transfer medium advances through the pressure nip.

15. An electrophotographic reproduction apparatus comprising:

means for developing a toned image and transferring that image to a transfer medium;

means for fusing the toned image to the transfer medium by advancing the transfer medium with the toned image thereon through a pressure nip; and means for substantially reducing the pressure at the pressure nip for one or more brief intervals as the toned image on the transfer medium advances through the pressure nip, the number of intervals being established by the length of the transfer medium.

* * * * *